US011440059B2

(12) United States Patent
Rattunde

(10) Patent No.: US 11,440,059 B2
(45) Date of Patent: Sep. 13, 2022

(54) WASHING MACHINE FOR LONGITUDINAL PROFILED SECTIONS WITH A FILM COVER, AND METHOD FOR WASHING LONGITUDINAL PROFILED SECTIONS

(71) Applicant: Rattunde & Co GmbH, Ludwigslust (DE)

(72) Inventor: Ulrich Rattunde, Bentwisch (DE)

(73) Assignee: Rattunde AG, Ludwigslust (DE)

( * ) Notice: Subject to any disclaimer, the term of this patent is extended or adjusted under 35 U.S.C. 154(b) by 210 days.

(21) Appl. No.: 15/746,019

(22) PCT Filed: Jul. 12, 2016

(86) PCT No.: PCT/EP2016/066556
§ 371 (c)(1),
(2) Date: Jan. 19, 2018

(87) PCT Pub. No.: WO2017/012928
PCT Pub. Date: Jan. 26, 2017

(65) Prior Publication Data

US 2018/0207688 A1 Jul. 26, 2018

(30) Foreign Application Priority Data

Jul. 20, 2015 (DE) ..... 10 2015 111 730.4

(51) Int. Cl.

| | |
|---|---|
| ***B08B 3/02*** | (2006.01) |
| ***B08B 9/023*** | (2006.01) |
| ***B08B 3/04*** | (2006.01) |
| ***B08B 3/08*** | (2006.01) |
| ***B08B 11/02*** | (2006.01) |
| ***B08B 3/06*** | (2006.01) |

(52) U.S. Cl.
CPC ..... *B08B 3/022* (2013.01); *B08B 3/04* (2013.01); *B08B 3/08* (2013.01); *B08B 9/023* (2013.01); *B08B 11/02* (2013.01); *B08B 3/041* (2013.01); *B08B 3/06* (2013.01); *B08B 2209/02* (2013.01)

(58) Field of Classification Search
None
See application file for complete search history.

(56) References Cited

U.S. PATENT DOCUMENTS 5,549,759 A * 8/1996 Lithander ..... B08B 3/02 134/153
2005/0087214 A1* 4/2005 Ransley, Jr. ..... B08B 3/041 134/25.1

FOREIGN PATENT DOCUMENTS

CA 2933743 A1 * 7/2015 ..... B08B 3/04
DE 10 2013 114850 A1 6/2015
EP 0 630 296 A1 12/1994
EP 0630296 B1 * 2/2000 ..... B08B 3/02

(Continued)

*Primary Examiner* — Mikhail Kornakov
*Assistant Examiner* — Pradhuman Parihar
(74) *Attorney, Agent, or Firm* — Bay State IP, LLC

(57) ABSTRACT

The invention relates to a washing machine for longitudinal profiled sections (5), comprising a drum (1, 2) that can be rotated about a horizontal rotational axis (10, 11) and comprises a plurality of receiving areas (101, 102, 103, 104, 105, 106, 107, 108, 109 or 200, 201, 202, 203, 204, 205, 206, 207, 208, 209, 210) which are arranged along the circumference of the drum, which are laterally delimited by lamellas (3, 4), which are open in the radial direction, and into which the longitudinal profiled sections (5) can be inserted along the longitudinal direction (L).

12 Claims, 2 Drawing Sheets

(56) References Cited

FOREIGN PATENT DOCUMENTS

Figure 1:
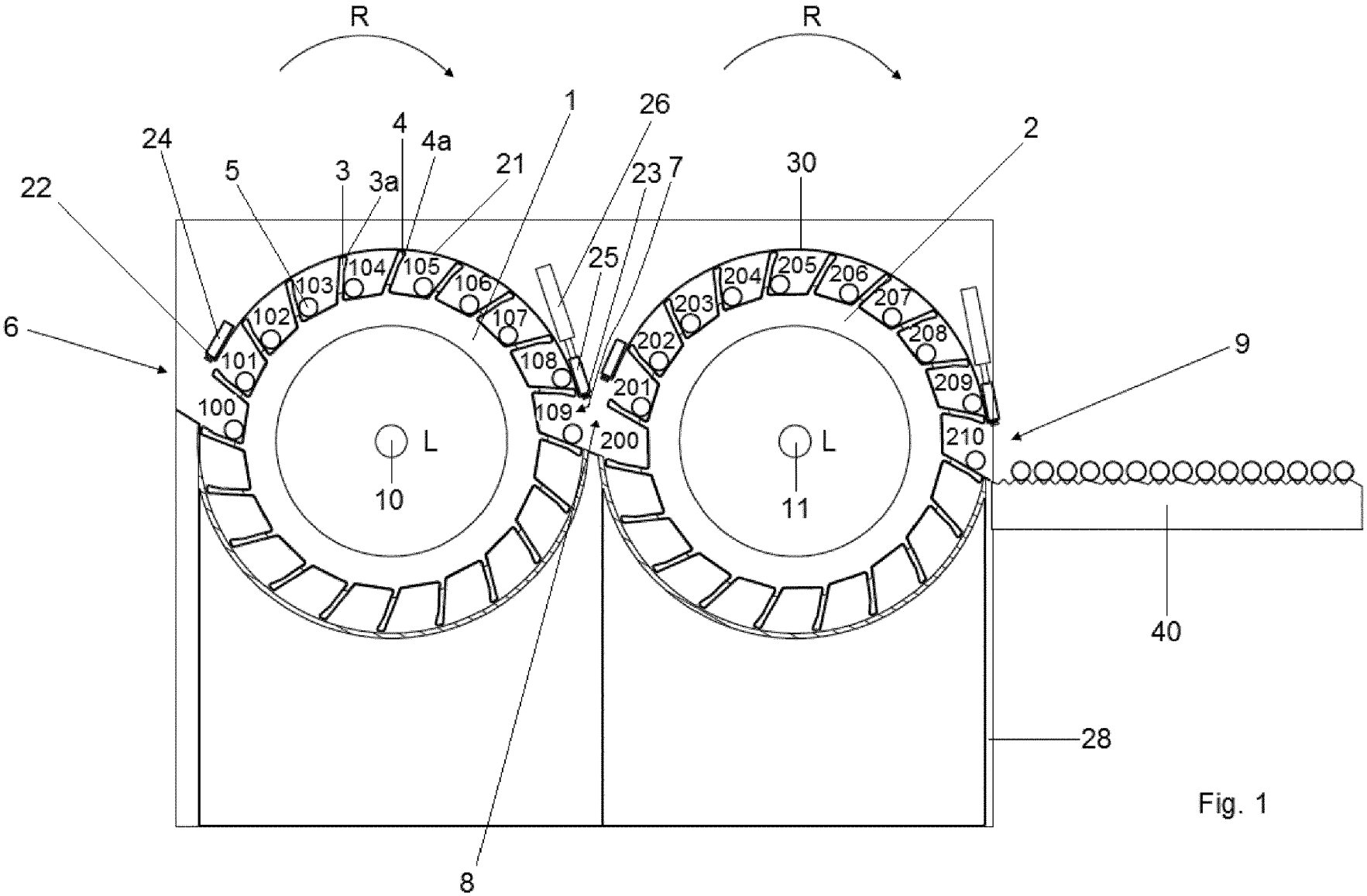

| | | | |
|---|---|---|---|
| JP | 000H07507228 | A | 10/1995 |
| WO | 2015/097114 | A1 | 7/2015 |

* cited by examiner

WASHING MACHINE FOR LONGITUDINAL PROFILED SECTIONS WITH A FILM COVER, AND METHOD FOR WASHING LONGITUDINAL PROFILED SECTIONS

CROSS REFERENCE TO RELATED APPLICATION

This application is for entry into the U.S. National Phase under § 371 for International Application No. PCT/EP2016/066556 having an international filing date of Jul. 12, 2016, and from which priority is claimed under all applicable sections of Title 35 of the United States Code including, but not limited to, Sections 120, 363, and 365(c), and which in turn claims priority under 35 USC 119 to German Patent Application No. 10 2015 111 730.4 filed on Jul. 20, 2015.

The invention relates to a washing device for longitudinal profiles according to the preamble to claim 1 and to a method for washing longitudinal profiles.

Washing machines for cleaning pipe sections are known for example from EP 0 638 370 A1. However, a disadvantage of these washing machines is that scratches can occur on the outer wall of sensitive pipes, because in particular pipes of small diameter can fall out of the receiving areas too soon and can become scratched. In particular, the washing machines cannot be adjusted for pipes of different diameters.

Furthermore, from DE 10 2013 114 850 A1 a washing machine for pipe sections is known in which the height of the outlet opening is adjustable. However, a disadvantage of the said washing machine is the fact that washing fluid must be forced through the chambers, which are delimited laterally by lamellas, in order to achieve a sufficient cleaning effect, but in this case a large quantity of water flows out of the chambers between the edges of the lamellas and the cover.

On the one hand, in addition to ever higher requirements are made for precision when cutting to length longitudinal profiled sections, in particular pipes, which may be in the micrometre range and below it, and also ever higher requirements are made for gentle handling, in particular of the outer surfaces of the cut longitudinal profiled sections. In particular, the cut longitudinal profiled sections can be used later as exhaust pipes, etc. In this case no scratches at all should occur on the outer faces. On the other hand, for reasons of environmental protection, economical handling of the washing fluid is required.

The object of the present invention is to provide an apparatus and a method for washing longitudinal profiled sections which make it possible to wash longitudinal profiled sections as gently as possible, but also to save water.

This is achieved with regard to the apparatus by a washing machine referred to above which has the features of claim 1.

Longitudinal profiled sections are understood here to be hollow or solid profiled sections, in particular pipes which are made from different materials or may include these, but longitudinal profiled sections are preferably understood to be metal or steel profiled sections.

The washing machine for longitudinal profiled sections has a drum which is rotatable about a horizontal axis of rotation oriented in the longitudinal direction. The axis of rotation is preferably exactly horizontal or at least arranged horizontally relative to the ground at an angle of +1-10°. Along the circumference of the drum there are provided a plurality of receiving areas which are delimited laterally by lamellas and are open in the radial direction, and into which the longitudinal profiled sections can be inserted along the longitudinal direction.

Each of the receiving areas has a leading lamella and a trailing lamella. Each of the lamellas extends over the entire longitudinal extent of the drum. The lamellas have an open edge externally in the radial direction. The lamellas are preferably inclined forwards in the direction of rotation of the drum.

The washing machine has a receiving area for the longitudinal profiled sections, an outlet opening at a distance from the receiving opening in the rotational direction of the drum for the longitudinal profiled sections, and a transport path which runs between the receiving opening and the outlet opening for the longitudinal profiled sections.

The transport path for the longitudinal profiled sections can lie above the axis of rotation, but also below the axis of rotation.

The washing machine has at least one washing fluid outlet which the receiving areas pass during the rotation of the drum and out of which washing fluid flows in the currently passing receiving area flows and thereby washes the longitudinal profiled section inserted into the receiving area. The at least one washing fluid outlet is arranged on one of the end faces of the drum alongside the transport path. These outlets may be washing fluid nozzles which are arranged in a curve adjacent to one another washing fluid and which spray, inject or force the washing fluid in the longitudinal direction into the respective passing chamber.

The washing fluid may be water and/or water enhanced with additives; in this case in particular corrosion inhibitors, oil or another agent can be used as additives.

According to the invention a flexible film covers at least the receiving areas passing the washing fluid outlet, thereby directly contacting the lamellas, preferably the outer edges of the lamellas. Due to the direct contact of the film with the lamellas, in particular the outer edges of the lamellas, the radially outer faces of the receiving areas through which the washing fluid flows are closed off in a less water-permeable or even water-impermeable manner. Advantageously a greater washing and cleaning effect is achieved by the use of less washing fluid.

The drum is preferably mounted rotatably relative to the film whilst the film itself is arranged in a fixed position relative to a frame of the washing machine. The drum rotates on an inner face along the film, whilst the outer edges of the lamellas slide over the inner face of the film.

The film is stretched along a portion of the outer circumference of the drum and along the entire longitudinal extent of the drum. Thus the film not only lies loosely on the outer circumference of the drum, but also it is preferably provided on its long edges with tensioning supports, which are tensioned by means of tensioners around the outer circumference of the drum.

The tensioners may be springs or pneumatic cylinders. The tensioners are not completely regulated during operation, so that a change in size of the film due to parameter changes such as temperature changes, moisture content changes or similar are compensated for, that is to say the tension of the film is continuously kept substantially constant, preferably exactly constant and as a result the film exerts a constant force on the lamellas and maintains its sealing effect even in the event of changing external parameters.

During the rotary movement of the drum the film advantageously has direct contact with radially outer edges of the lamellas along the entire longitudinal extent of the lamellas of the passing receiving area. As a result, advantageously each of the receiving areas passing the washing fluid outlet is advantageously protected over the entire longitudinal extent against the escape of washing fluid, which enhances the cleaning effect.

Advantageously at least one tensioning means is provided which is arranged along a long edge of the film and which produces a permanent pretension on the film during the rotation of the drum. The tensioning means can have a tensioning support, which is firmly connected to the film along a long edge of the film, for example is screwed or welded to the film or is connected to the film by a clip connection.

The tensioning support can be connected to tensioners which exert a tensioning force on the tensioning support, so that the film is permanently pressed onto the drum.

Advantageously a long edge the film, which extends along the outlet opening, is configured to be adjustable in the circumferential direction of the drum. Thus the height of the outlet openings is adjustable in the circumferential direction. By adjustment of the position of the long edge of the film the height of the outlet opening can be changed and thus it is possible to counteract premature fall out of the longitudinal profiled section from the receiving area. For this purpose the height of the outlet opening is adapted approximately to the diameter of the longitudinal profiled section. The height of the outlet opening is preferably somewhat greater than the diameter of the longitudinal profiled section.

In a particularly preferred embodiment of the invention the film has a tensioning device on both long edges. The two tensioning devices preferably act together, so that the film is movable back and forth in the circumferential direction on the drum. Thus the height of the outlet opening can be varied by displacement of the entire film and at the same time the tension of the film is maintained.

Advantageously the at least one washing fluid outlet is arranged adjacent to the receiving opening in the direction of rotation and at least one blow drying outlet is arranged adjacent to the at least one washing fluid outlet in the direction of rotation. A blow dryer makes it possible in the same washing machine to pre-dry the longitudinal profiled sections which have already been washed.

The transport path is preferably provided above the axis of rotation of the drum, but it is also conceivable to arrange the transport path below the axis of rotation of the drum. In both cases the film is tensioned along a portion of the circumference of the drum, and it covers the transport path or at least a section of the transport path, in the sense that along the transport path the receiving areas are closed off radially outwards by the film. Regardless of whether the transport path is provided above or below with respect to the axis of rotation, the receiving areas are closed off by the film against escape of washing fluid.

The washing machine can preferably have two or more drums arranged alongside one another, which enable automatic transfer of the longitudinal profiled sections from one drum to the further drum, wherein the one drum can be provided with a washing fluid and the further drum can be provided with a further washing fluid different from the washing fluid.

The film can be a plastic film, preferably having a thickness between 1 and 6 mm, particularly preferably 1 and 3 mm. This may be a polyethylene film.

In a second aspect, the object of the invention is achieved by a method with the features of claim 13. The method is suitable in particularly suitable to be carried out with one of the above-mentioned washing devices.

In this case longitudinal profiled sections are inserted into receiving areas which are open in the radial direction and are delimited laterally by lamellas. The longitudinal profiled sections are transported along a transport path from a receiving opening for the longitudinal profiled sections in the direction of rotation of the drum to an outlet opening spaced apart from the receiving opening. The washing machine has at least one washing fluid outlet out of which washing fluid flows into the currently passing receiving area and thereby washes the inserted longitudinal profiled section.

According to the invention a flexible film is tensioned over at least the receiving areas passing the washing fluid outlet, thereby directly contacting the lamellas of the passing receiving areas. Due to the tensioning of the flexible film according to the invention, the receiving areas are closed off radially outwards and thus an escape of the washing fluid flowing through the receiving areas is counteracted. As a result the quantity of washing fluid required is advantageously significantly decreased.

The film is advantageously displaced relative to a frame in the circumferential direction of the drum, by combined adjustment of interacting tensioning devices arranged on both long edges of the film. As a result the height of an outlet opening can be adapted to the diameter of the longitudinal profiled sections and thus falling out of the longitudinal profiled sections from the outlet opening can be counteracted.

The washing fluid outlets and/or the blow dryer outlets are fixed in position relative to the frame of the washing machine. During operation the receiving areas rotate past the washing fluid outlets and/or blow dryer outlets.

Figure 2:
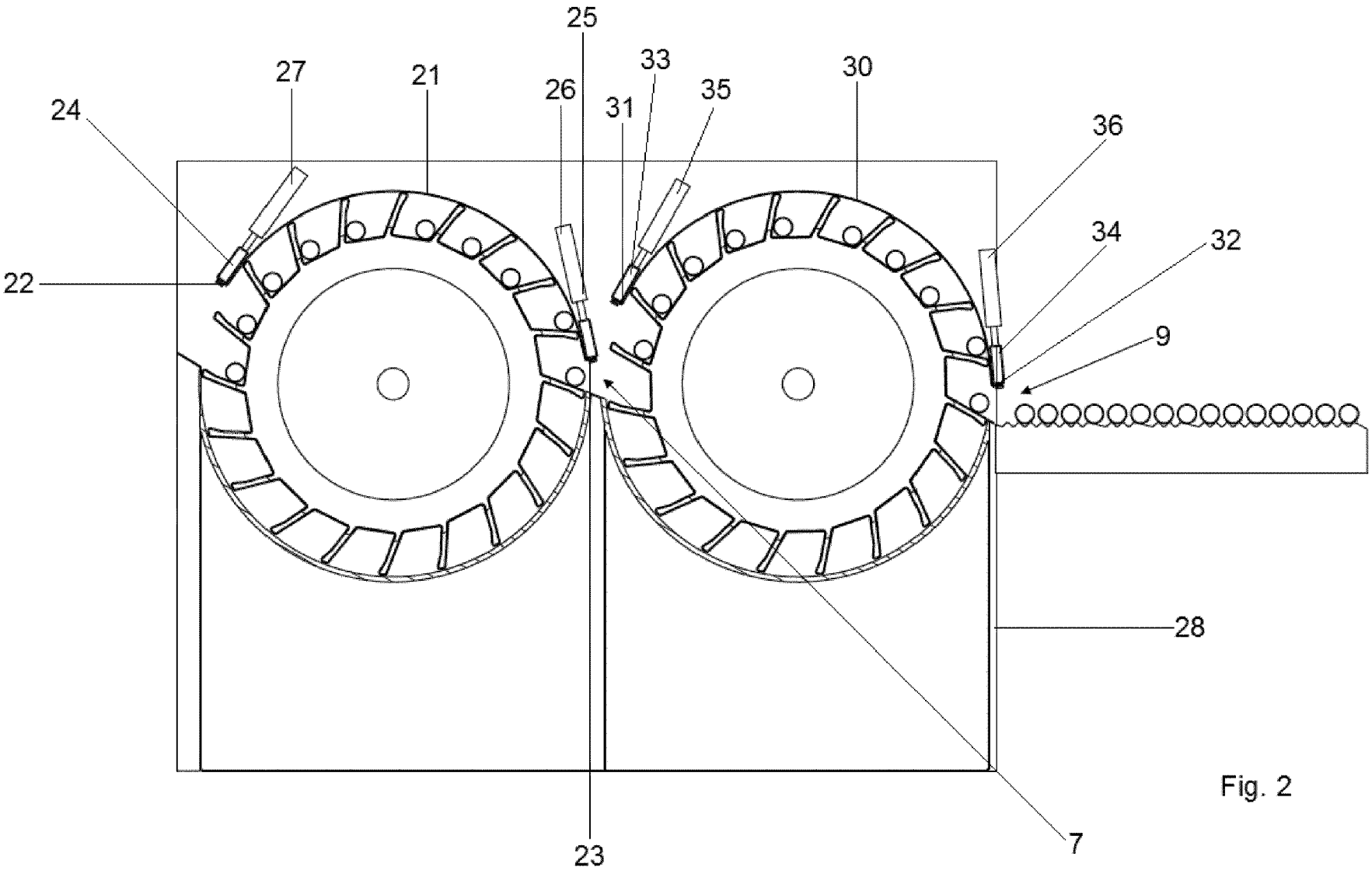

The invention is described with reference to two embodiments, and in the drawings:

FIG. 1 shows a first embodiment of the washing machine according to the invention comprising two washing drums, each having a film which can be tensioned on one side, FIG. 2 shows a washing machine comprising two washing drums, each having a film which can be tensioned on both sides.

FIG. 1 shows two drums 1, 2 which are arranged adjacent to one another and functionally connected one after the other, and are rotatable about a respective horizontal axis of rotation 10,11 in a longitudinal direction L. Chambers 101, 102, 103, 104, 105, 106, 107, 108, 109 or 200, 201, 202, 203, 204, 205, 206, 207, 208, 209, 210, which in each case extend over an entire longitudinal extent of the drums 1, 2, are in each case oriented in the longitudinal direction L along the outer circumference of each of the two drums 1, 2. Each of the chambers 101, 102, 103, 104, 105, 106, 107, 108, 109 or 200, 201, 202, 203, 204, 205, 206, 207, 208, 209, 210 is delimited in the circumferential direction by two lateral closed lamellas 3, 4. The drums 1, 2 have for example a length of two metres and a diameter of just one metre. One, two or more longitudinal profiled sections 5 can be inserted into each of the chambers 101, 102, 103, 104, 105, 109 or 200, 201, 202, 203, 204, 205, 206, 207, 208, 209, 210. The washing machine in FIG. 1 has a receiving opening 6 on the extreme left for the individual longitudinal profiled sections 5. The drum 1 has an outlet opening 7, out of the longitudinal profiled section 5 can roll automatically via a receiving opening 8 of the further drum 2 and into the chamber 200 of the further drum 2. The further drum 2 likewise has an outlet opening 9 for the individual longitudinal profiled sections 5.

The chambers 101, 102, 103, 104, 105, 106, 107, 108, 109 are open externally in the radial direction and in the washing machine according to the invention they are preferably closed towards the exterior in a watertight manner by a flexible film 21, and the chambers 200, 201, 202, 203, 204, 205, 206, 207, 208, 209, 210 are open externally in the radial direction and are preferably closed towards the exterior in a watertight manner by a further flexible film 30. Each of the two films 21, 30 has two long edges 22, 23 or 31, 32 in each case which are provided in each case with a tensioning support 24, 25 or 33, 34.

The following description is confined to the drum 1 in FIG. 1. However, it can be applied analogously to the further drum 2.

The drum 1 in FIG. 1 rotates clockwise in the direction of rotation R. The chambers 100, 101, 102, 103, 104, 105, 106, 107, 108, 109 of the drum 1 are equipped with longitudinal profiled sections 5, and the longitudinal profiled sections 5 rotate along a transport path, which is provided above the axis of rotation 10 of the drum 1, to the outlet opening 7 of the drum 1. A plurality of washing fluid nozzles (not shown) are provided on an end face of the drum 1. The washing fluid nozzles are arranged on the end face of the first four chambers 102, 103, 104, 105 which are completely closed radially towards the exterior in the direction of rotation R. All chambers 100, 101, 102, 103, 104, 105, 106, 107, 108, 109 of the drum 1 are open on both end faces. Through the washing fluid nozzles a washing fluid is sprayed under pressure via the open end face through the chambers 102, 103, 104, 105 in the longitudinal direction L of the chambers 102, 103, 104, 105, so that the longitudinal profiled sections 5 arranged in the chambers 102, 103, 104, 105 are washed. The washing fluid from the chambers 102, 103, 104, 105 flows out again from the chambers 102, 103, 104, 105 which are likewise open on the opposing end faces. In the direction of rotation R, downstream of the washing nozzles, blow drying nozzles are provided on the end faces of the subsequent chambers 106, 107, 108. The blow drying nozzles are provided on the end face of the last three chambers 107, 108 before the outlet opening 7 of the drum 1. The washing fluid may be water or water with additives, such as for example corrosion inhibitors, oil or other additives. The washing fluid compositions of the one drum 1 and the further drum 2 can be the same or different.

Each of the chambers 100, 101, 102, 103, 104, 105, 106, 107, 108, 109 of the drum 1 is delimited laterally by a leading lamella 4 and a trailing lamella 3. In terms of their height the lamellas 3, 4 extend substantially in the radial direction. However, they have a slight inclination in the direction of rotation R, which makes it possible that the cross-sectionally round, preferably cross-sectionally circular longitudinal profiled sections 5 can roll out of the chamber 109 automatically in the region of the outlet opening 7.

The film 21 can be a plastic film, for example a polyethylene film, which has a thickness of 1 to 6 mm, preferably 1 to 3 mm, particularly preferably precisely 3 mm. The film 21 is flexible, but is not or only slightly elastic. The film 21 is cut to a substantially rectangular shape. Each of the tensioning supports 24, 25 extending along the entire long edge 22, 23 is provided along each of the long edges 22, 23 of the film 21 extending in the longitudinal direction L. The tensioning supports 24, 25 are tensioning supports 24, 25 which are adapted in the longitudinal direction L to the length the one drum 1, and in which the respective long edges 22, 23 of the film 21 gripped or firmly screwed or fastened in some other way.

In FIG. 1 one long edge 22 of the film 21 is connected to the tensioning support 24 which is fixed in position relative to a frame 28 of the washing machine, whilst the second long edge 23 of the film 21 is connected to the tensioning support 25 which is movable relative to the frame 28. The tensioning support 25 is fastened to a tensioner 26, which tensions the film 21 along the transport path of the longitudinal profiled sections 5 under continuous tension on the outer circumference of the drum 1, so that the film 21 rests on outer lamella edges 3*a*, 4*a* of the individual lamellas 3, 4 and the lamellas 3, 4 slide internally over the film 21 during the rotary movement of the drum 1. In this case, however, the film 21 rests closely and, due to the exerted tensioning force, firmly on the lamellas 3, 4, so that the washing fluid flowing through the chambers 102, 103, 104, 105 cannot flow out of the chambers 102, 103, 104, 105 laterally in the radial direction via the lamella edges 3*a*, 4*a*.

The washing machine illustrated in FIG. 1 enables the first washing and drying in the drum 1, and in the further drum 2 the further washing and further drying of the individual longitudinal profiled sections 5, which are then transported away from the washing machine by means of a conveyor 40.

The second embodiment according to FIG. 2 has a corresponding construction to the first embodiment, and the same references signify the same features.

However, each of the two films 21, 30 is provided on both long edges 22, 23, 31, 32 with a respective one of the tensioning supports 24, 25, 33, 34, although the tensioning supports 24, 25, 33, 34 of the two films 21, 30 are coupled to the tensioner 26 or the tensioners 27, 35, 36 respectively, so that by combined adjustment of the two tensioners 26, 27, or 35, 36 of each of the two drums 1, 2 a displacement of both the one film and also the further film 21, 30 by means of the one or the further drum 1, 2 along the respective circumferential direction is made possible, wherein the once the film 21, 30 has been set in its angular position it then remains fixed in position relative to the frame 28.

The two tensioners 26, 27 or 35, 36 of the film 21 or of the further film 30 make it possible to lower the films 21, 30 at the respective outlet opening 7, 9 to such an extent, and to configure the outlet openings 7, 9 to be so narrow in terms of their height, that they are only slightly higher than the diameter of the longitudinal profiled section 5, so that the longitudinal profiled section 5 does not fall out of the chamber 109 of the drum 1 too early, but only rolls out of the chamber 109 of the drum very late and is transferred to the chamber 200 of the further drum 2 or rolls out of the chamber 210 of the further drum 2 and is transferred to the conveyor 40.

LIST OF REFERENCES

1 drum
2 drum
3 lamella
**3*a*** lamella edge
4 lamella
**4*a*** lamella edge
5 longitudinal profiled section
6 receiving opening
7 outlet opening
8 receiving opening
9 outlet opening
10 axis of rotation
11 axis of rotation
21 film
22 long edge
23 long edge
24 tensioning support
25 tensioning support
26 tensioner
27 tensioner
28 frame

30 film
31 long edge
32 long edge
33 tensioning support
34 tensioning support
35 tensioner
36 tensioner
40 conveyor
100-109 chambers
200-210 chambers
L longitudinal direction
R direction of rotation

The invention claimed is:

1. A washing machine for longitudinal profiled sections, comprising a drum which can be rotated about a horizontal rotational axis and comprises a plurality of receiving areas which are arranged along the circumference of the drum, which are laterally delimited by lamellas, which are open in the radial direction, and into which the longitudinal profiled sections can be inserted along the longitudinal direction (L), also comprising a receiving opening for the longitudinal profiled sections, an outlet opening at a distance from the receiving opening in the rotational direction (R) of the drum for the longitudinal profiled sections, and a transport path which runs between the receiving opening and the outlet opening for the longitudinal profiled sections, also comprising at least one washing fluid outlet by which the receiving areas pass when the drum is rotating and out of which the washing fluid flows into a currently passing receiving area, whereby the inserted longitudinal profiled section is washed, characterised by at least two drums arranged adjacent to one another and enable an automatic transfer of the longitudinal profiled sections from the drum to the further drum, and the drum is provided with a washing fluid and the further drum is provided with a further washing fluid and characterized by a flexible film for each drum having two tensioning devices containing a tensioning support and a tensioner each on both long edges, which are acting together, whereby the film covers the receiving areas passing by the at least one washing fluid outlet, thereby directly contacting the lamellas of the passing receiving area, and a long edge of the flexible film which extends along the outlet opening is configured to be adjustable in the circumferential direction of the drum by actuating the tensioners such that the angular position of the film is set and remains fixed once it has been set in position relative to the frame by combined adjustment of the two tensioners and the height of the outlet opening is adjustable in the circumferential direction and adapted to the diameter of the longitudinal profiled section such that the longitudinal profiled section does not fall but only rolls out of the receiving areas of the drum.

2. The washing machine according to claim 1, characterised in that the drum is mounted rotatably with respect to the film.

3. The washing machine according to claim 1, characterised in that the film is tensioned around a second of the outer circumference of the drum.

4. The washing machine according to claim 1, characterised in that during the rotary movement of the drum the film directly contacts the radially outer edges of the lamellas along the entire longitudinal extent of the lamellas of the currently passing receiving area.

5. The washing machine according to claim 1, characterised by at least one tensioning device which is arranged along a long edge of the film and produces a permanent pretension of the film during the rotation of the drum.

6. The washing machine according to claim 1, characterised in that a long edge of the film is adjustable along the outlet opening in circumferential direction of the drum and determines the height of the outlet opening in the circumferential direction of the drum.

7. The washing machine according to claim 1, characterised in that the film has on both long edges one of the tensioning devices which interact and by which the film is displaceable back and forth in the circumferential direction.

8. The washing machine according to claim 1, characterised in that the at least one washing fluid outlet is arranged adjacent to the receiving opening in the direction of rotation (R) and at least one blow drying outlet is arranged adjacent to the at least one washing fluid outlet in the direction of rotation (R).

9. The washing machine according to claim 1, characterised in that the transport path is provided above the axis of rotation of the drum.

10. The washing machine according to claim 1, characterised in that the film is a plastic film, 1 to 6 mm thick.

11. A method of washing longitudinal profiled sections comprising the steps of: utilizing the washing machine for longitudinal profiled sections of claim 1, wherein longitudinal profiled sections are inserted in to receiving areas which are delimited laterally by lamellas and are open in the radial direction, the longitudinal profiled sections are transported along a transport path from a receiving opening for the longitudinal profiled sections in a direction of rotation (R) of a drum to an outlet opening spaced apart from the receiving opening, and during the rotation of the drum the longitudinal profiled sections pass at least one washing fluid outlet, from which washing fluid flows out into the currently passing receiving area and thereby washes the inserted longitudinal profiled section, and a flexible film is tensioned over at least the receiving areas currently passing the washing fluid outlet and directly contacts the lamellas of the passing receiving area and a long edge of the flexible film which extends along the outlet opening is adjusted in the circumferential direction of the drum by a tensioning devices containing a tensioning support and a tensioner each on both long edges of the flexible film, which are acting together, and the height of the outlet opening is adjusted in the circumferential direction and adapted to the diameter of the longitudinal profiled section such that the longitudinal profiled section does not fall but only rolls out of the receiving areas of the drum.

12. The method according to claim 11, characterised in that the flexible film is displaced relative to a frame in the circumferential direction of the drum, by combined adjustment of interacting tensioning devices arranged on both long edges of the flexible films.

* * * * *